United States Patent [19]

Henstock et al.

[11] 3,948,033

[45] Apr. 6, 1976

[54] BULKED POLYESTER HETEROYARNS

[75] Inventors: Arthur Robert Henstock; Walter Raymond Jones; Frank Wilding, all of Harrogate, England

[73] Assignee: Imperial Chemical Industries Limited, London, England

[22] Filed: Feb. 21, 1974

[21] Appl. No.: 444,599

[30] Foreign Application Priority Data

Feb. 23, 1973 United Kingdom..... 8989/73

[52] U.S. Cl...... 57/140 R; 57/140 BY; 57/157 F

[51] Int. Cl.[2]..... D02G 3/28; D02G 3/26

[58] Field of Search..... 57/140 BY, 140 R, 140 J, 57/144, 157 F, 34 B

[56] References Cited

UNITED STATES PATENTS

| | | | |
|---|---|---|---|
| 2,985,995 | 5/1961 | Bunting et al. | 57/140 R |
| 3,091,913 | 6/1963 | Field | 57/140 BY |
| 3,208,125 | 9/1965 | Hall et al. | 57/140 BY X |
| 3,423,923 | 1/1969 | Hume | 57/140 BY |
| 3,691,750 | 9/1972 | Waters | 57/140 BY X |
| 3,732,684 | 5/1973 | Csok et al. | 57/140 BY |

*Primary Examiner*—Donald E. Watkins
*Attorney, Agent, or Firm*—Roderick B. Macleod

[57] ABSTRACT

A bulked polyester continuous filament heteroyarn composed of uncrimped filaments and helically crimped filaments, and having alternating compact and loopy zones. The helically crimped filaments include homofilaments (e.g., false-twist bulked) and heterofilaments.

8 Claims, No Drawings

BULKED POLYESTER HETEROYARNS

The present invention relates to bulked polyester heteroyarns.

According to the present invention, a bulked heteroyarn is composed of two types of filaments, being 25 – 75% by weight substantially uncrimped, polyester filaments and 75 – 25% by weight helically crimped, polyester filaments, and has compact zones wherein substantially the whole of the filaments of one type is wrapped about and interlaced to some extent with filaments of the other type, alternating with loopy zones wherein at least the major proportion of the filaments of the one type are separated from the filaments of the other type and form irregularly shaped loops extending longitudinally of and outwardly from the axis of the yarn.

Such bulked heteroyarn is produced by feeding two types of filaments, being 25 – 75% by weight of the resultant yarn of substantially uncrimped, polyester filaments and 75 – 25% by weight of the resultant yarn of helically crimped or potentially helically crimpable polyester filaments, to an interlacing zone under different tensions, and relaxing the filaments before or after the interlacing zone (this relaxation step being optional in the case of the feedstock comprising helically crimped filaments).

The two types of filaments may be interlaced by passing them through one or more fluid jets as described in U.K. patent specification No. 924089.

One filament type may be fed to the interlacing zone at a tension different from that of the other filament type by any suitable method. The tension differences may be conveniently adjusted, for example, by feeding the two types of filaments to the interlacing zone by separate feed rolls or air forwarding jets operating at different rates, or by forwarding the two types of filaments to a relaxation zone, located before or after the interlacing zone, in which one filament type relaxes or extends to a greater extent than the other filament type. Relaxation during a heat treatment is particularly suitable.

A bulked heteroyarn of the invention, according to one embodiment, has compact zones wherein substantially the whole of the uncrimped filaments are wrapped about and interlaced to some extent with the helically crimped filaments, and loopy zones wherein the loops are formed solely by a majority of the uncrimped filaments.

An alternative embodiment of a bulked heteroyarn has compact zones wherein substantially the whole of the helically crimped filaments are wrapped about and interlaced to some extent with the un-crimped filaments, and loppy zones wherein the loops are formed by a majority of the helically crimped filaments.

In either case, the direction of wrapping of the wrapped filaments about the yarn axis may differ intermittently along the yarn. Preferably, each type of filament constitutes 50% by weight of the yarn.

Such yarns have desirable properties, and when knitted or woven into fabrics, the fabrics have extremely good handle and resemble woollen fabrics.

The form of heteroyarn produced, i.e., whether the uncrimped or crimped filaments form the loops, depends upon which type of filament is under the lower tension in the interlacing zone. Thus, where the crimped or potentially crimpable filaments are under the lower tension, the majority of them form the loops. The difference in tension between the two types of filaments controls the length of the compact zones and the loopy zones. When the differnce is great, the loopy zones will have a greater length and a greater mean loop width than when the tension difference is small.

Preferably the heteroyarns exhibit between 50 and 150 loopy zones per meter. The loopy zones have lengths varying between less than 0.25 cm and greater than 2.0 cm. Preferably, at least 70% of the loopy zones have lengths in the range 0.3 cm to 1.25 cm, and less than 5% of the loopy zones have lengths greater than 1.5 cm. Desirably, the maximum length of the loopy zone does not exceed 1.75 cm.

The loopy zones have widths varying between less than 0.1 cm and greater than 0.3cm. Preferably, at least 65% of the loopy zones have widths in the range 0.1 cm to 0.3 cm and less than 10% greater than 0.35 cm.

The un-crimped polyester filaments may be formed from polyester homopolymers or copolymers, examples being polyethylene terephthalate and 80/20 by weight polyethylene terephthalate/polyethylene isophthalate copolymer respectively.

Examples of helically crimped filaments include filaments which are crimped along their length as those produced by conventional false twisting, by heat relaxing conjugate filaments comprising two different types of polymer eccentrically disposed across the cross-section of the filaments, or by heat relaxing asymmetrically heated normal homo-filaments.

Potentially helically crimpable filaments include those which upon relaxation, particularly at elevated temperatures, develop crimp, e.g., eccentric conjugate filaments and asymmetrically heated filaments.

When the bulked heteroyarns are produced from un-crimped homofilaments and helically crimped eccentric conjugate filaments, the two type of filaments may be spun simultaneously from the same spinneret, and drawn together before passing to the interlacer and relax zone. On the other hand, when the heteroyarns are produced from standard homofilaments and false twist crimped homofilaments, it is possible to combine the false twist filaments with the standard homofilaments at the draw roll during the drawing of the latter or the homofilaments may be fed into the take out roll of a false twister and the combined filaments interlaced before the wind up.

Particularly attractive yarns are obtained when at least some of the filaments are dyed or pigmented, or are differently dyeable. Very attractive yarns are obtained when two or more differently dyed, pigmented or dyeable types of filaments are used.

The invention will be further described with reference to the following Examples.

EXAMPLE 1

A polyethylene terephthalate polymer of intrinsic viscosity 0.675 dl/g was spun into a yarn composed of 72 filaments and having a spun denier of 470. The spun yarn also had a birefringence value of 0.008. The yarn was drawn at a draw ratio of 3.4 between a heated feed roll of surface temperature 85°C and a draw roll at a draw speed of 1260 feet per minute.

A polyethylene terephthalate polymer of intrinsic viscosity 0.675 dl/g and a polyethylene terephthalate polymer of intrinsic viscosity 0.485 dl/g were spun into a yarn composed of 72 bicomponent filaments and having a spun denier of 470. The bicomponent filaments consisted of 50% by weight of each polymer in a side-by-side relationship. The spun yarn had a mean birefringence value of 0.0074 and a birefringence differential of 0.005. The yarn was drawn at a draw ratio of 3.22 between a heated feed roll of surface temperature 85°C and a draw roll at a draw speed of 1,260 feet per minute and simultaneously dephased as in U.K. patent specification No. 1142617. The draw yarn was then relaxed at a relax ratio of 1.3 and a temperature of 225°C, by passing it through a slotted tube containing heated circulating air, between the draw roll and a relax roll.

The drawn/relaxed bicomponent filament yarn was tensioned to remove most of the crimp and then dephased (opened) by passage over a flanged roll before being combined with the drawn homofilament yarn by being fed to the draw roll of the draw stage of the latter yarn. On leaving the draw roll, the two yarns were passed together through an air intermingling jet having a 0.125 inch diameter yarn passageway, two 0.04 inch diameter air inlets at 45° to each other and at 77° to the axis of the yarn passageway. Air was fed to the intermingling jet at a pressure of 80 pounds per square inch.

The intermingled hereroyarn issuing from the intermingling jet was then relaxed at a relax ratio of 1.15 and at a temperature of 225°C by passing it through a slotted tube containing heated circulating air.

The final heteroyarn exhibited alternating compact and loopy zones. At least 70% of the loopy zones had lengths in the range 0.5 cm to 1.25 cm and less than 5% had lengths in the range 1.5 cm to in excess of 2 cm. 86% of the loopy zones had widths in the range 0.1 cm to 0.3 cm and 1% in the range 0.35 cm to 0.4 cm. No widths exceeded 0.4 cms.

EXAMPLE 2

A polyethylene terephthalate polymer of intrinsic viscosity 0.675 dl/g was spun into a yarn composed of 72 filaments and having a spun denier of 470. The spun yarn had a birefringence of 0.0083. The yarn was drawn at a draw ratio of 3.2 between a heated feed roll of surface temperature 85°C and a draw toll at a draw speed of 1260 feet per minute.

A polyethylene terephthalate polymer of intrinsic viscosity 0.675 dl/g and a polyethylene terephthalate of intrinsic viscosity 0.485 dl/g were spun into a yarn composed of 72 bicomponent filaments and having a spun denier of 477. The bicomponent filaments consisted of 50% by weight of each polymer in a side-by-side relationship. The spun yarn had a mean birefringence value of 0.0071 and a birefringence differential of 0.005. The yarn was drawn with dephasing as in Example 1 at a draw ratio of 3.22 between a heated feed roll of surface temperature 85°C and a draw roll at draw speed of 1,260 feet per minute. The drawn yarn was then relaxed at a draw ratio of 1.3 and at a temperature of 225°C, by passing it through a slotted tube containing circulating heated air, between the draw roll and a relax roll.

The drawn/relaxed bicomponent filament yarn was tensioned to remove most of its crimp and then dephased (opened) by passage over a flanged roll before being fed to the draw roll of the draw stage of the drawn homofilament yarn. The two yarns were taken from the draw roll and passed together through an air intermingling jet of the type described in Example 1. The air pressure was 80 pounds per square inch at a flow rate of 230 cubic feet per hour gauge.

The intermingled yarn was relaxed at a relax ratio of 1.14 and at a temperature of 235°C by passing it through a slotted tube having heated air circulating therethrough.

The resultant heteroyarn exhibited alternating compact and loopy zones. At least 70% of the loopy zones had lengths in the range 0.5 cm to 1.25 cm and less than 5% had lengths in the range 1.5 cms to in excess of 2 cm. 85% of the loopy zones had widths in the range 0.1 cm to 0.3 cm and 4% in the range 0.35 cm to 0.4 cm. No widths exceeded 0.4 cm.

EXAMPLE 3

A polyethylene terephthalate polymer of intrinsic viscosity 0.675 dl/g was spun into a yarn composed of 60 filaments and having a spun denier of 470. The spun yarn also had a birefringence value of 0.0084. The yarn was drawn at a draw ratio of 3.22 between a heated feed roll of surface temperature 85°C and a draw roll at a draw speed of 1,260 feet per minute.

A polyethylene terephthalate polymer of intrinsic viscosity 0.675 dl/g and a polyethylene terephthalate polymer of intrinsic viscosity 0.485 dl/g were spun into a yarn composed of 60 bicomponent filaments and having a spun denier of 470. The bicomponent filaments consisted of 50% by weight of each polymer in a side-by-side relationship. The spun yarn had a mean birefringence of 0.0074 and a birefringence differential of 0.005. The yarn was drawn at a draw ratio of 3.22 between a heated feed roll of surface temperature 85°C and a draw roll at a draw speed of 1,260 feet per minute with dephasing as in Example 1. The drawn yarn was then relaxed at a relax ratio of 1.47 and at a temperature of 250°C by entraining the yarn in a cold air ejector and directing it into a slotted tube containing heated stationary air (as described in U.S. Pat. No. 3,644,968) between the draw roll and a relax roll.

The drawn/relaxed bicomponent filament yarn was dephased (opened) by passage over a flanged roll before being fed to the draw roll of the draw stage of the drawn homofilament yarn. The two yarns were taken from the draw roll and passed together through an air intermingling jet of the type described in Example 1 at an air pressure of 80 pounds per square inch.

The intermingled yarn was relaxed at a relax ratio of 1.15 and a temperature of 220°C by passing it through a slotted tube having heated air circulating therethrough.

The heteroyarn had alternating compact and loopy zones. At least 70% of the loopy zones had lengths in the range 0.5 cm to 1.25 cm and less than 5% had lengths in the range 1.5 cm to greater than 2 cm. All the loopy zones had widths in the range 0.1 cm to 0.3 cm.

EXAMPLE 4

The conditions utilised were the same as those described in Example 2 but with the following exceptions:

a. The homofilament yarn was drawn at a draw ratio of 3.1.

b. The bicomponent filament yarn was drawn and then relaxed at a draw ratio of 1.47 and at a temperature of 200°C, by entraining the yarn in a cold air ejector and directing into a slotted tube containing heated stationary air (as described in U.S. Pat. No. 3,644,968, between the draw roll and a relax roll.

The heteroyarn produced had alternating compact and loopy zones. At least 70% of the loopy zones had lengths in the range 0.5 cm to 1.25 cm and less than 5 had lengths in the range 1.5 cms to greater than 2 cm. All the loopy zones had widths in the range 0.1 cm to 0.3 cm.

EXAMPLE 5

The conditions utilized were the same as described in Comparative Example A but with the following exceptions:

The homofilament yarn and the bicomponent filament yarn were relaxed at relax ratios of 1.24 and 1.40, respectively.

The resultant heteroyarn had alternating compact and loopy zones. At least 70% of the loopy zones had lengths in the range 0.5 cm to 1.25 cm and less than 5% had lengths in the range 1.5 cm to greater than 2 cm. Approximately 85% of the loopy zones had widths in the range 0.1 cm to 0.3 cms and 3% had widths in the range 0.3 cms to 0.4 cms. No widths exceeded 0.4 cm.

EXAMPLE 6

The conditions utilized were the same as described in Example 5 but with the following exceptions:

The homofilament yarn and the bicomponent filament yarn were relaxed at relax ratios of 1.20 and 1.35 respectively.

The heteroyarn had alternating compact and loopy zones. Substantially all the loopy zones (94%) had lengths in the range 0.5 cm to 1.25 cm and only 1% of the loopy zones had lengths exceeding 1.50 cm. Approximately 84% of the loopy zones had widths in the range 0.1 to 0.3 cm and 3% had widths in the range 0.3 cms to 0.4 cms. No widths exceeded 0.4 cms.

EXAMPLE 7

A 94/6 polyethylene terephthalate/isophthalate copolymer of intrinsic viscosity 0.675 dl/g was spun into a yarn composed of 60 homofilaments and having a spun denier of 470. The spun yarn had a birefringence value of 0.0078.

A polyethylene terephthalate polymer of intrinsic viscosity 0.675 dl/g and a polyethylene terephthalate polymer of intrinsic viscosity 0.485 dl/g were spun into a yarn composed of 60 bicomponent filaments and having a spun denier of 535. The bicomponent filaments consisted of 50% by weight of each polymer in side-by-side relationship. The spun yarn had a mean birefringence value of 0.005 and a birefringence differential of 0.005.

The yarns were brought together and drawn at a draw ratio of 3.5 between a heated feed roll of surface temperature 85°C and a draw roll at a draw speed of 1,260 feet per minute, and relaxed at a relax ratio of 1.47 and a temperature of 250°C by entraining the yarns in a cold air ejector and directing them into a slotted tube containing heated stationary air, between the draw roll and a relax roll.

The yarns were then formed into a heteroyarn by passing them through an intermingling jet as described in Example 1.

The heteroyarn had alternating compact and loopy zones along its length. At least 70% of the loopy zones had lengths in the range 0.5 cm to 1.25 cm and less than 5% had lengths above 1.5 cm.

Approximately 69% of the loopy zones had widths in the range 0.1 cm to 0.3 cm, 23% in the range 0.3 cm to 0.35 cm and 4% in the range 0.35 cm to 0.4 cm. No widths exceeded 0.4 cm.

COMPARATIVE EXAMPLE A

A polyethylene terephthalate polymer of intrinsic viscosity 0.675 dl/g was spun into a yarn composed of 60 filaments and having a spun denier of 461. The spun yarn had a birefringence value of 0.009.

A polyethylene terephthalate polymer of intrinsic viscosity 0.675 dl/g and a polyethylene terephthalate polymer of intrinsic viscosity 0.485 dl/g were spun into yarn composed of 60 bicomponent filaments and having a spun denier of 535. The bicomponent filaments consisted of 50% by weight of each polymer in side-by-side relationship. The spun yarn had a birefringence value of 0.005 and a birefringence difference of 0.005.

The two yarns were then fed to a heated feed roll of surface temperature 85°C and then to a stepped draw roll. The homofilament yarn was drawn at a draw ratio of 3.1 and the bicomponent filament yarn was drawn at a draw ratio of 3.5 and a draw speed of 1,260 feet per minute. From the stepped draw roll, the yarns were relaxed by passing them to a relax roll by entraining the yarns in a cold air ejector and directing them into a slotted tube containing heated stationary air, prior to the relax roll. The relaxation temperature was 250°C and the relax ratios of the homofilament yarn and the bicomponent filament yarn were 1.3 and 1.47 respectively.

The drawn/relaxed yarns were then intermingled to form a heteroyarn by being passed through an intermingling jet. The latter had a yarn passageway of 0.3 inch diameter, slotted for each of string-up, and two 0.047 inch diameter air inlets communicating with the yarn passageway. The air inlets are diametrically opposed, i.e., at 180° to each other, and are disposed at 90° to the axis of the yarn passageway. The air pressure was 80 pounds per square inch at a flow rate of 330 cubic feet per hour.

The heteroyarn exhibited alternating compact and loopy zones. Approximately 78% of the loopy zones had lengths in the range 0.5 cm to 1.25 cm and 6% of the loopy zones had lengths greater than 1.50 cm. Approximately 85% of the loopy zones had widths in the range 0.1 cm to 0.3 cm and approximately 8% had widths in the range 0.3 cm to 0.4 cm. No widths exceeded 0.4 cms.

COMPARATIVE EXAMPLE B

The conditions utilized were the same as described in Comparative Example A but with the following exceptions:

The yarns were intermingled between the relax tube and the relax roll instead of after the relax roll.

The heteroyarn so produced exhibited alternating compact and loopy zones. Approximately 89% of the loopy zones had lengths in the range 0.5 cm to 1.25 cm and 7% had lengths greater than 1.5 cm. At least 65% of the loopy zones had widths in the range 0.1 cm to 0.3 cm and less than 10% had widths in the range 0.3 cm to 0.4 cm.

The physical properties of the bulked heteroyarns made according to the Examples were as follows:

| Example No. | Denier | % Shrinkage | Load in grams to extend Yarn X% | | | | | | Breaking Load gm/denier | % Extension |
|---|---|---|---|---|---|---|---|---|---|---|
| | | | 5% | 10% | 20% | 30% | 40% | 50% | | |
| 1 | 370 | | 194 | 396 | 754 | — | — | — | 2.35 | 25 |
| 2 | 377 | 9.4 | 197 | 326 | 555 | 728 | — | — | 2.53 | 36 |
| 3 | 360 | 6.5 | 184 | 341 | 695 | 818 | — | — | 2.28 | 29 |
| 4 | 382 | 9.6 | 174 | 280 | 532 | 693 | — | — | 2.13 | 37 |
| 5 | 405 | 0.5 | 169 | 229 | 395 | 681 | — | — | 2.91 | 43 |
| 6 | 390 | 1.5 | 191 | 274 | 473 | 772 | — | — | 2.56 | 39 |
| 7 | 426 | 0.7 | 153 | 184 | 276 | 374 | 521 | — | 2.27 | 63 |
| Comparative Example A | 415 | 0.5 | 174 | 219 | 364 | 589 | 836 | — | 2.95 | 49 |
| Comparative Example B | 400 | 1.5 | 132 | 240 | 404 | 683 | — | — | 2.23 | 40 |

Those yarns of Examples 1 to 7 which do not have widths of the loopy zones in excess of 0.3 cm have been found to be particularly suitable for making knitted and woven fabrics. No slubs are present in those fabrics made from yarns having loopy zone lengths not exceeding 1.75 cm. Slubbing occurs in fabrics made from yarns having greater than 5% loopy zone lengths in the range 1.5 cms to greater than 2.0 cms.

Unacceptable fabrics are produced from yarns having greater than 5% loopy zone lengths in the range 1.5 to greater than 2.0 cm and greater than 10% loopy zone widths in the range 0.35 cm to greater than 0.4 cm. In all these instances unacceptability is due to the presence of excessive snagging or slubbing in the fabrics.

EXAMPLES 8 to 11

The following examples illustrate how the type of filaments forming the major proportion of the loops can be varied by adjusting the speed at which one type of filament is fed to the interlacer relative to the speed of the other type of filaments.

A polyethylene terephthalate copolymer, containing 7½ mole % of ethylene isophthalate units, of intrinsic viscosity 0.70 dl/g and a polyethylene terephthalate homopolymer of intrinsic viscosity 0.485 dl/g were spun into a yarn composed of 60 bicomponent filaments of circular cross section and having a spun decitex of 506. The bicomponent filaments consisted of 50% by weight of each polymer in an asymmetric sheath core relationship with the copolymer as the sheath. The spun yarn had a mean birefringence value of 0.008.

A polyethylene terephthalate polymer of intrinsic viscosity 0.675 dl/g was spun into a yarn composed of 60 filaments of circular cross section and having a spun decitex of 506. The spun yarn had a birefringence value of 0.008.

The two yarns were drawn separately between a heated feed roll of surface temperature 85°C and a draw roll at a draw ratio of 3.22. The drawn yarns were fed to a pigtail guide and plied together before being passed directly to an air intermingling jet having a 0.19 inch diameter yarn passageway, two 0.04 inch diameter air inlets at 47° to each other and at 80° to the axis of the yarn passageway. The intermingler was mounted on an air expansion cone having an 8° taper. Air was fed to the intermingling jet at a temperature of 230°C and at a pressure of 20 pounds per square inch.

The intermingled heteroyarn issuing from the intermingling jet assembly was then passed to a take out roll where it was gripped by a rubber nip roll. The yarn was then would up at a tension of 5 gm.

Details of the roll speeds and yarn properties are given in the table below.

| Example | Draw Roll Speed (ft/min) | | Take out roll speed (ft/min) | Type of filaments forming major proportion of loops | % loops having lengths in the range 0.3–1.25 cms | % loops of length >1.5 cm | % loops of width >0.4 cm |
|---|---|---|---|---|---|---|---|
| | Homofil | Bicomponent | | | | | |
| 8 | 1200 | 1550 | 810 | Bicomponent | >70 | 0 | 0 |
| 9 | 1200 | 1380 | 810 | Bicomponent | >70 | 0 | 0 |
| 10 | 950 | 1200 | 810 | Bicomponent | >70 | 5 | 5 |
| 11 | 1240 | 1200 | 810 | Homofil | >70 | 0 | 0 |

The yarn of Example 10 had loopy zones in which the major proportion of the filaments in the loops were bicomponent filaments but the proportion of homofilaments was greater than that in the yarns of Examples 8 and 9.

EXAMPLES 12 AND 13 AND COMPARATIVE EXAMPLE C

The following Examples illustrate the production of yarns having compact zones and loopy zones by interlacing homofilaments with helically crimped false twist filaments, and how the type of filaments forming the major proportion of the loops can be varied by adjusting the relative feed rates of the two types of filaments. Comparative Example C shows that when the speeds of the two types of filaments are the same, the resulting yarn does not have compact and loopy zones.

A polyethylene terephthalate polymer of intrinsic viscosity 0.675 dl/g was spun into a yarn composed of 60 filaments of circular cross section and having a spun decitex of 506. The spun yarn had a birefringence value of 0.008.

The yarn was drawn between a heated feed roll of surface temperature 85°C and a draw roll at a draw ratio of 3.22 and passed directly to a pigtail guide where it was plied together with a commercial false twist crimped polyethylene terephthalate yarn of 167 decitex and composed of 30 circular filaments. The yarns were passed from the pigtail guide to an air intermingling jet having a 0.19 inch diameter yarn passageway, two 0.04 inch diameter air inlets at 47° to each other and at 80° to the axis of the yarn passageway. Air was fed to the intermingling jet at a pressure of 20 pounds per square inch.

The intermingled heteroyarn issuing from the intermingling jet assembly was then passed to a take out roll where it was gripped by a rubber nip roll. The yarn was wound up at a tension of 5 gm.

Details of the roll speeds and yarn properties are given in the table below.

| Example | Draw Roll Speed (ft/min) Homofil | False Twist | Take Out Roll Speed (ft/min) | Type of filaments forming major proportion of loops | % loops having lengths in the range 0.3–1.25 cm | % loops of length 1.5 cm | % loops of width 0.4 cm |
|---|---|---|---|---|---|---|---|
| 12 | 1250 | 1200 | 1150 | Homofil | 70 | 9.9 | 0 |
| 13 | 1130 | 1200 | 1100 | False twist | 70 | 8 | 8 |
| Comparative Example C | 1200 | 1200 | 1250 | No loops formed | — | — | — |

In Examples 1 to 7, the majority of the loops of the heteroyarns produced were composed of the helically crimped filaments.

Fabrics made from yarns according to the invention exhibit desirable staple-like effects and have an excellent warm, soft handle reminiscent of woollen fabrics.

The measurements of loopy zone widths and lengths were visually carried out by projecting an image of a yarn onto a screen and making the appropriate measurements over meter lengths of the yarn. The length of a loopy zone was taken as the distance between the axis of the yarn and the outermost point of the loopy zone.

What we claim is:

1. A bulked heteroyarn composed of two types of filaments, being 25–75% by weight substantially uncrimped, polyester filaments and 75–25% by weight helically crimped, polyester filaments, and having compact zones wherein substantially the whole of the filaments of one type is wrapped about and interlaced to some extent with filaments of the other type, alternating with loopy zones wherein at least the major proportion of the filaments of the one type are separated from the filaments of the other type and form irregularly shaped loops extending longitudinally of and outwardly from the axis of the yarn and wherein said heteroyarn has between 50 and 150 said loopy zones per meter and said loopy zones have lengths varying between 0.25 cm and 2.0 cm.

2. A bulked heteroyarn according to claim 1, having compact zones wherein substantially the whole of the uncrimped filaments are wrapped about and interlaced to some extent with the helically crimped filaments, and loopy zones wherein the loops are formed solely by a majority of the uncrimped filaments.

3. A bulked heteroyarn according to claim 1, having compact zones wherein substantially the whole of the helically crimped filaments are wrapped about and interlaced to some extent with the uncrimped filaments, and loopy zones wherein the loops are formed by a majority of the helically crimped filaments.

4. A bulked heteroyarn according to claim 2 wherein the direction of wrapping of the wrapped filaments about the yarn axis differs intermittently along the yarn.

5. A bulked heteroyarn according to claim 1, wherein at least 70% of the loopy zones have lengths in the range 0.3 cm. to 1.25 cm., and less than 5% of the loopy zones have lengths greater than 1.5 cm.

6. A bulked heteroyarn according to claim 1, wherein the maximum length of the loopy zones does not exceed 1.75 cm.

7. A bulked heteroyarn according to claim 1 wherein the loopy zones have widths varying between less than 0.1 cm. and greater than 0.3 cm.

8. A bulked heteroyarn according to claim 3 wherein the direction of wrapping of the wrapped filaments about the yarn axis differs intermittently along the yarn.

* * * * *